United States Patent [19]

Lucas et al.

[11] 4,451,830

[45] May 29, 1984

[54] VHF OMNI-RANGE NAVIGATION SYSTEM ANTENNA

[75] Inventors: James G. Lucas, Wahroonga; Alan C. Young, West Pennant Hills; Paul M. Hinds, Newtown, all of Australia

[73] Assignee: The Commonwealth of Australia, Australia

[21] Appl. No.: 280,180

[22] Filed: Jul. 6, 1981

[30] Foreign Application Priority Data

Dec. 17, 1980 [AU] Australia ..... PE6964

[51] Int. Cl.[3] ..... H01Q 13/12; H01Q 13/18

[52] U.S. Cl. ..... 343/768; 343/770

[58] Field of Search ..... 343/767, 768, 770, 771

[56] References Cited

U.S. PATENT DOCUMENTS 2,573,461 10/1951 Lindenblad ..... 343/770
2,642,529 6/1953 Frankel ..... 343/767
2,659,002 11/1953 Keeler ..... 343/767
3,056,130 9/1962 Charman ..... 343/767

*Primary Examiner*—Eli Lieberman
*Attorney, Agent, or Firm*—Ladas & Parry

[57] ABSTRACT

An antenna which is suitable for use in a very high frequency omni-directional range (VOR) navigation system for aircraft. The antenna is driven to radiate reference and variable phase signals which provide flight bearing information to an aircraft which enters the radiated field.

The antenna comprises a cylindrical radiator which is formed with four orthogonally disposed longitudinally extending slots, and each slot is backed by a separate cavity which extends into the cylinder. Each cavity has an effective depth which is greater than the radial or, more usually, the diametral dimension of the cylinder, and all four cavities are configured so as to locate wholly within the cylinder.

13 Claims, 15 Drawing Figures

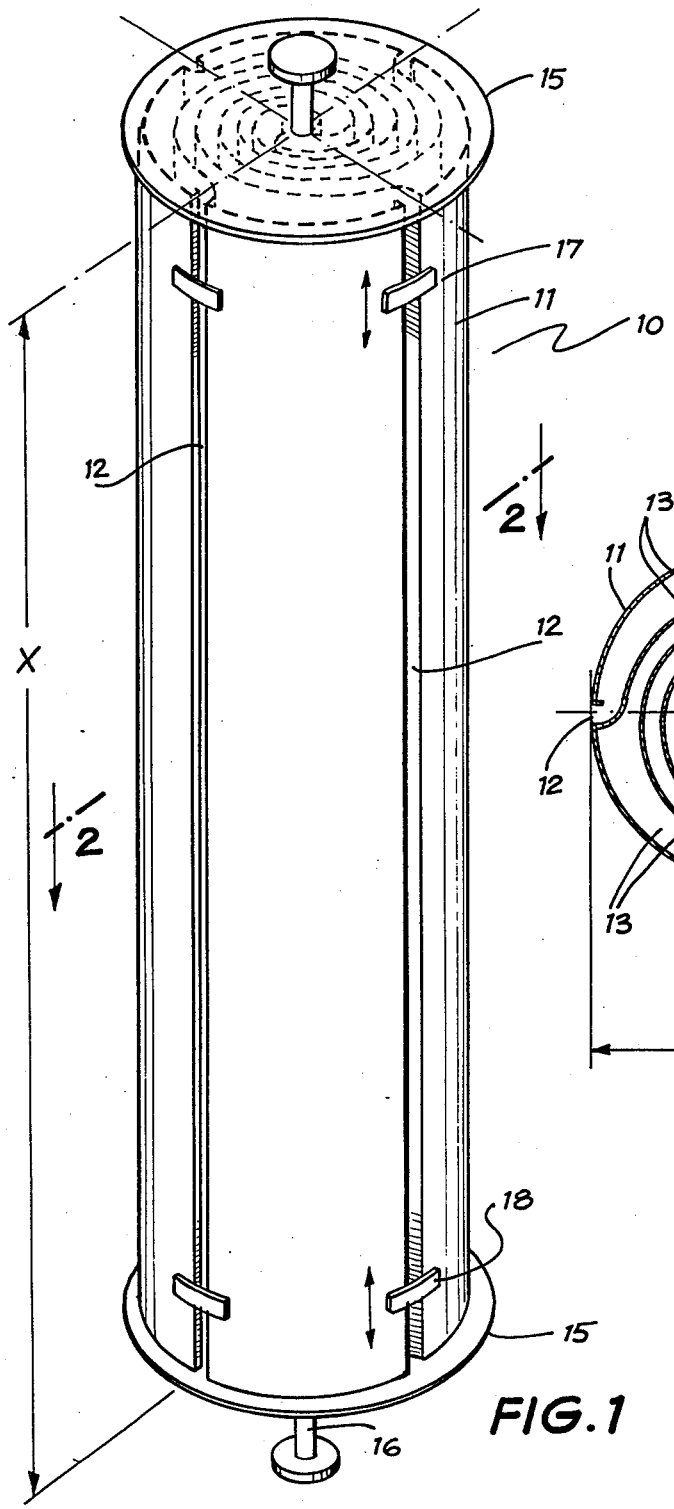
FIG. 1
FIG. 2
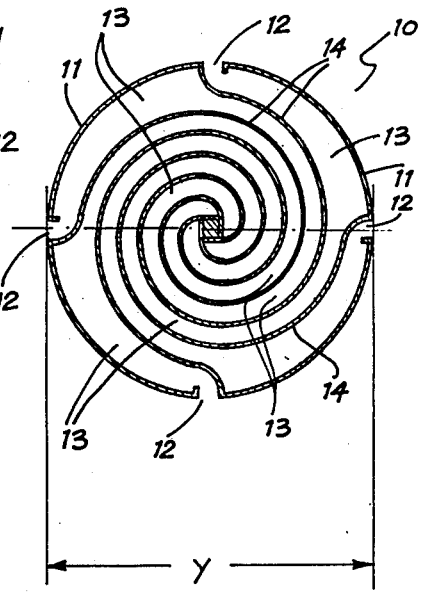

VHF OMNI-RANGE NAVIGATION SYSTEM ANTENNA

FIELD OF THE INVENTION

This invention relates to a cylindrical antenna which is formed with cavity backed slots. The antenna has been developed primarily for use in a very high frequency omni-directional range (VOR) navigation system and the antenna is herein described in the context of such application. However, it is to be understood that the antenna may have application in other systems, in particular as a localiser antenna element in an instrument landing system (ILS) for aircraft.

BACKGROUND OF THE INVENTION

The VOR system as such is employed extensively throughout the world and it is operated to provide an aircraft with flight path bearing information. Two signals are radiated by a VOR antenna to produce a rotating field in space, one signal being referred to as a reference phase signal which is radiated omni-directionally and the other signal being referred to as a variable phase signal which has a phase which varies linearly with azimuth angle. Bearing information is derived by detecting the phase difference between the reference and variable phase signals as received by an aircraft flying toward or from the VOR site.

The reference phase signal is generated as a radio frequency (r.f.) carrier which has a frequency falling within the region 108–118 MHz and which is amplitude modulated by a 30 Hz frequency modulated 9960 Hz subcarrier. The variable phase signal comprises a portion of the r.f. carrier from which the modulation is eliminated and, when radiated, is space amplitude modulated at 30 Hz. The space modulation is achieved by feeding the radiating antenna so as to produce a field which rotates at 30 Hz.

The bearing information is derived and indicated by a receiver within an aircraft. After processing in the r.f. stage of the receiver and subsequent detection, the received (audio) reference and variable phase signals are processed in separate channels and are applied as separate inputs to a phase comparator. Bearing information relative to the VOR site is indicated by the phase difference between the reference and variable phase signals.

Antennas which currently are employed for radiating VOR signals are:

1. An arrangement of four or five closely spaced Alford loops. When five loops are employed a central one is driven to radiate the reference phase signal and the four surrounding loops are driven to radiate the variable phase information. When a four-loop arrangement is employed the reference and variable phase signals are combined in simple bridges and fed to the four loops.

2. The so-called AME slotted cylinder antenna which incorporates four orthogonally disposed longitudinally extending slots located within the peripheral wall of a cylindrical radiator. All slots are excited with the reference phase signal and respective pairs of the slots are fed with sine and cosine signal components of the variable phase signal.

3. An antenna which is known as the Thomson CSF antenna and which comprises four cylinders and two Alford loops. The four cylinders are terminated by common (upper and lower) metal end plates, are disposed parallel to one another, are arranged with their longitudinal axes centered on apices of a square and are excited to radiate the variable phase information. The Alford loops are located one above and the other below the end plates and are fed with the reference phase signal.

All of the abovementioned prior art VOR antennas have recognised deficiencies.

The arrangement which incorporates four or five Alford loops has a large octantal error. Octantal error is a bearing error which is cyclical in azimuth with a half-period of 45° and which increases in magnitude with increasing diameter of the complete antenna. The Alford loop arrangement has an inherently large diameter and, indeed, produces an octantal error which is unacceptable to regulatory authorities in Australia, although this can be overcome by precise but difficult to achieve control of drive currents. Moreover, the Alford loop arrangement is not very suitable for use in a multi-stack antenna array due to mutual coupling effects.

The AME slotted cylindrical antenna is an extremely difficult antenna to set-up and maintain because of inherent internal coupling between the slots and, due to the fact that it tends to have a narrow bandwidth, it is subject to environmental drift. Also, the antenna produces different radiation patterns in the vertical plane for reference and variable phase signal excitations, because the slots have different current distributions for the reference and the variable phase signal excitations. This is an undesirable feature when the antenna is located on difficult (i.e. short ground plane) sites and is a particularly undesirable feature in a multi-stack array.

The major deficiency of the Thomson CSF antenna flows from its use of completely separate antenna elements for radiating the reference and variable phase signals. As abovementioned, the variable phase signal is radiated from the four-tube arrangement, which has an excellent broad band frequency characteristic, but it is fundamentally not possible to excite the same four tubes with the reference phase excitation. To accommodate this problem the reference phase signal is fed to the two Alford loop antenna elements (at the top and bottom of the four tubes), but the Alford loop antennas have a very narrow bandwidth and the vertical pattern of the radiated reference phase signal rarely matches that of the variable phase signal, particularly on difficult short ground plane sites.

At this point it is mentioned that a recent development has been made in VOR systems for use at sites which have a limited counterpoise and which requires the use of multi-stack antenna arrays. Reference can be made to Australian Patent Application No. PE 4821, dated Aug. 1 1980, for particulars of such system. However, when employing multi-stack arrays it is necessary or, at least, desirable that the reference and variable phase radiation patterns should match in the vertical plane and this can be achieved only if the reference and variable phase excitations are added electrically to drive each of the stacked antennas.

SUMMARY OF THE INVENTION

The present invention seeks to provide a slotted cylindrical antenna which is suitable for use in a VOR system, which is suitable for radiating both reference and variable phase signals when used in a VOR system, which is constructed to avoid or minimise internal coupling between the slots, which can be employed as a single element or in a multi-stack array, and which can be constructed to provide for an acceptably low octantal error.

Thus, the present invention provides an antenna which comprises a cylinder having at least two slots formed within the peripheral wall thereof. The slots extend in the direction of the longitudinal axis of the cylinder and are spaced-apart around the periphery of the cylinder. Each slot is backed by a separate cavity which has a depth extending into the cylinder from the slot. The depth of each cavity is effectively greater than the radial dimension of the cylinder and the cavities are configured to locate wholly within the cylinder.

The cylinder preferably has a circular cross-section, although it might be formed for example with an elliptical, square or polygonal cross-section.

The number of slots provided within the peripheral wall of the antenna will depend upon the intended application of the antenna. For example, when employed as a localiser element in an ILS application, the antenna may be formed with two slots, for radiating 90 Hz and 150 Hz sideband signals, or it may be formed with three slots for radiating ILS carrier and sideband signals.

When the antenna is employed in a conventional VOR system, the cylinder will be provided with four orthogonally disposed longitudinally extending slots, all such slots being excited equally with a reference phase signal and respective ones of the slots being excited with components of the variable phase signal. Thus, diametrically disposed slots which form one pair of slots are excited with a sine component of the variable phase signal and the other pair of diametrically disposed slots (which are orthogonal to the first pair) are excited with a cosine component of the variable phase signal. The diametrically disposed slots of each pair are excited in phase opposition with the variable phase signal components so that, effectively, a rotating figure-of-eight variable phase field component is radiated by the antenna together with a circular reference phase field component.

The maximum diameter of the cylinder will be determined largely by the maximum octantal error allowable in any given application of the antenna (the magnitude of octantal error being determined by the maximum diameter of the antenna, as hereinbefore mentioned), and the longitudinal length of the slots is determined by the VOR system frequency, this normally being in the range of 108–118 MHz. Thus, in operation as a half-wave antenna, the slot would need to have a length of approximately $0.5\lambda_c$ meters, where $\lambda_c$ is the wavelength in the cavity, although the total length of the antenna would normally be made somewhat greater than this dimension to permit on-site adjustments to the slot length during tuning of the system. The depth of each cavity is determined as a function of the slot length and width and, when the antenna is employed in a VOR system, each cavity would normally have a depth which is effectively greater than the diametral dimension of the cylinder. Each cavity is "folded" to follow a non-linear path so that it may fit within the available space. Various ways in which folding of the cavity might be effected will be hereinafter described and illustrated.

Each slot is preferably fitted with at least one shorting bar or other suitable device for the purpose of adjusting the effective length of the slot and matching the slots.

The invention will be more fully understood from the following description of a preferred embodiment of a VOR antenna, the description being given with reference to the accompanying drawings.

BRIEF DESCRIPTION OF THE DRAWINGS

In the accompanying drawings,

FIG. 1 shows a perspective view of the antenna,

FIG. 2 shows a cross-sectional plan view of the antenna as viewed in the direction of section plane 2—2 of the FIG. 1.

DETAILED DESCRIPTION OF THE INVENTION

Figure 2A:
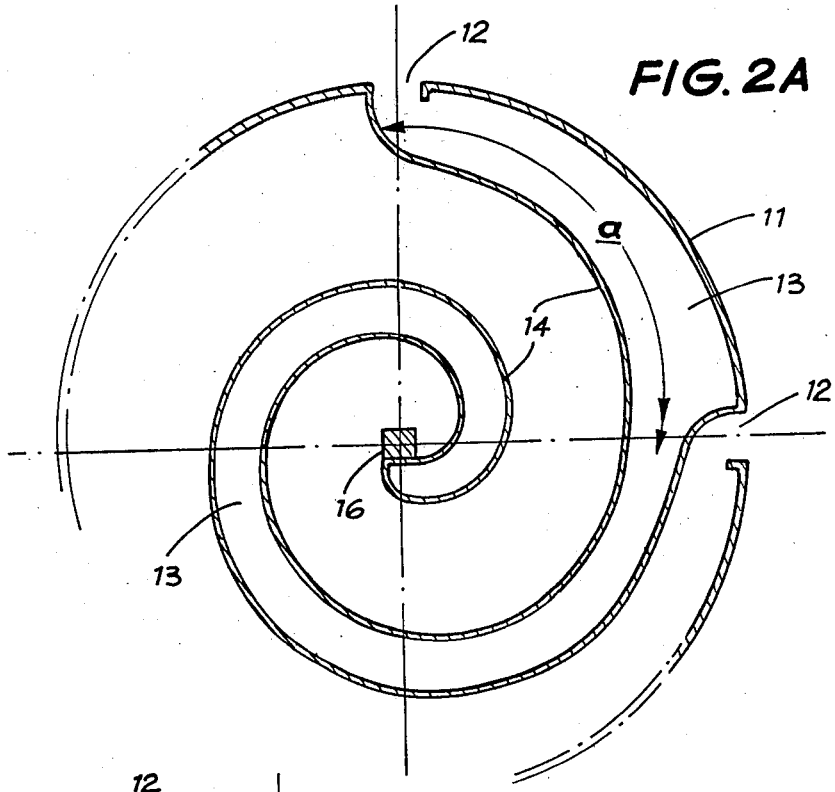
FIG. 2A shows an enlarged fragmentary view of one cavity of the antenna of FIG. 2.

As shown in FIGS. 1, 2 and 2A of the drawings, the antenna 10 has a cylindrical peripheral wall 11 which is constructed from a conductive material such as copper or aluminium. Four longitudinally extending, orthogonally disposed slots 12 are formed within the peripheral wall 11 and respective ones of the slots are backed by cavities 13. The cavities are separated from one another by spiral form metal partitions 14 and, therefore, each cavity 13 may be considered as being folded as a spiral within the body of the antenna. This arrangement provides for a compact antenna construction, with each of the cavities having a depth a (see FIGS. 2A, 5 and 6) which is greater than the maximum outside diameter of the complete antenna structure.

A metal plate 15 is fitted to each end of the antenna 10, whereby, but for the slots 12, the cavities 13 are closed, and a central support shaft 16 extends through the complete structure in a longitudinal direction.

Two longitudinally moveable metal bridges (i.e. shorting bars) 17 and 18 extend across each of the slots 12 and interconnect the side walls of each slot to define the upper and lower limits of the resonant magnetic dipole length of each slot. The upper bridge 17 is selectively positionable to set the frequency of radiation of the antenna and sufficient adjustment scope is provided to accommodate a frequency shift over the range 108–118 MHz. The lower bridge 18 is selectively positionable to permit matching of the four slots at a selected frequency.

The bridges 17 and 18 provide for "coarse" adjustment of the radiation frequency and slot matching, and "fine" tuning is provided by the positioning of vane elements 17*a* and 18*a* which are located within each of the cavities 13 at the rear of the respective slots 12.

Figure 2B:
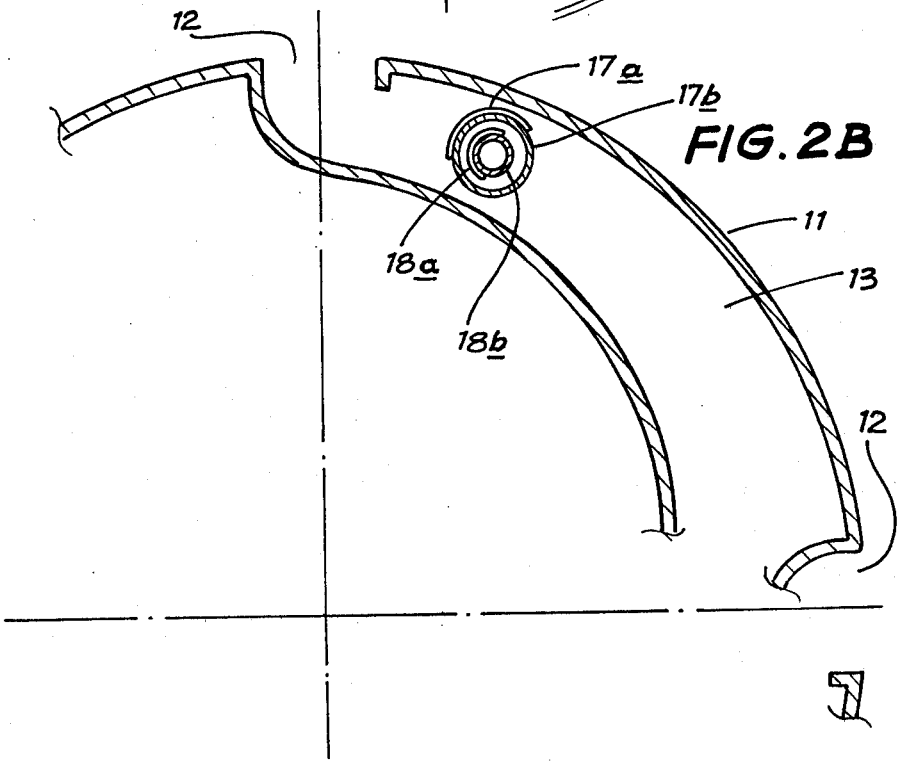
FIG. 2B shows a fragmentary view of the cavity as illustrated in FIG. 2A and in which a vane element is located for the purpose of tuning the cavity.

As shown in FIG. 2B, the vane elements 17*a* and 18*a* are carried by concentric tubes 17*b* and 18*b* which are located in each of the cavities 13. The tubes are formed from a dielectric material, they extend for the full length of the slots 12 and, although not so shown in the drawings, the tubes are supported in bearings and project from the lower end of the antenna so that they might be rotated manually or mechanically.

The vane element 17*a* is formed from metal and it extends arcuately around a portion of the periphery of the upper region of the outer tube 17*b*. The vane element 18*a* is formed in a similar manner but it extends around a peripheral portion of the lower region of the inner tube 18*b*.

Both of the vane elements 17*a* and 18*a* can be selectively positioned with rotation of the supporting tubes 17*b* and 18*b* to present a variable area of metal to the passage of electromagnetic fields in the respective cavities, but, even when exhibiting a maximum area of metal across the width of the cavities, the vane elements do not make electrical contact with the walls of the cavities.

Typical dimensions of the antenna structure as shown in FIGS. 1 and 2 are:

Length (X)=1.80 meters

Diameter (Y)=0.46 meters

Figure 3A:
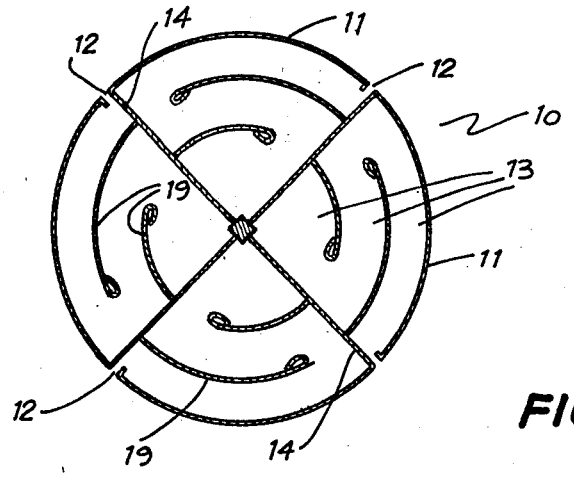
FIGS. 3A to 3C show cross-sectional plan views of three alternative embodiments of the antenna as shown in FIG. 1.
Figure 3B:
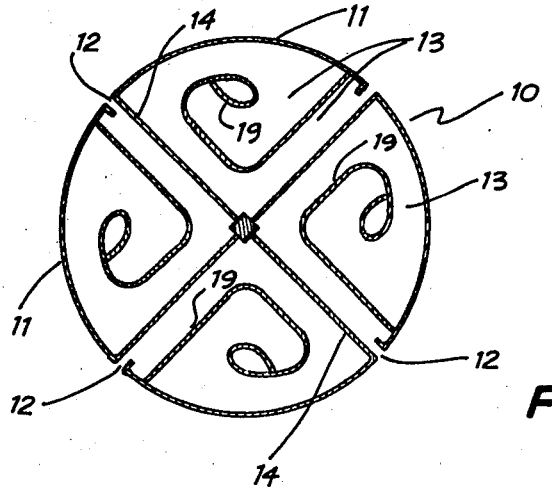
Figure 3C:
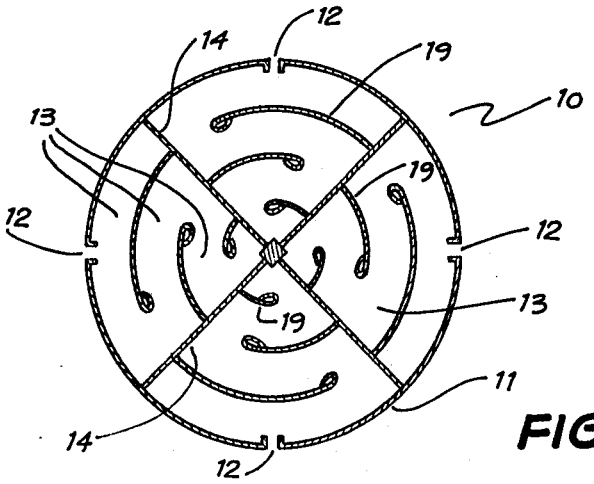

The antenna 10 may be constructed in various ways in order to obtain a desired depth a of the cavity behind each of the slots 12, and three alternative configurations are shown in FIGS. 3A to 3C. In each case, the peripheral wall 11 of the antenna is formed with four longitudinally extending slots 12 and each slot is backed by a folded cavity 13. The cavities are separated by partitions 14 and the respective cavities are defined by walls 19.

Characteristics and parameters which are relevant to the construction and operation of the antenna are now described.

The overall height (X) of the antenna is determined predominantly by the required length (l) of the slots 12 and the slot length (approximately $0.5\lambda_c$) is determined by the operating frequency. The wavelength $\lambda_c$ ($>\lambda$ free space) is the wavelength in the cavity 13.

Figure 4:
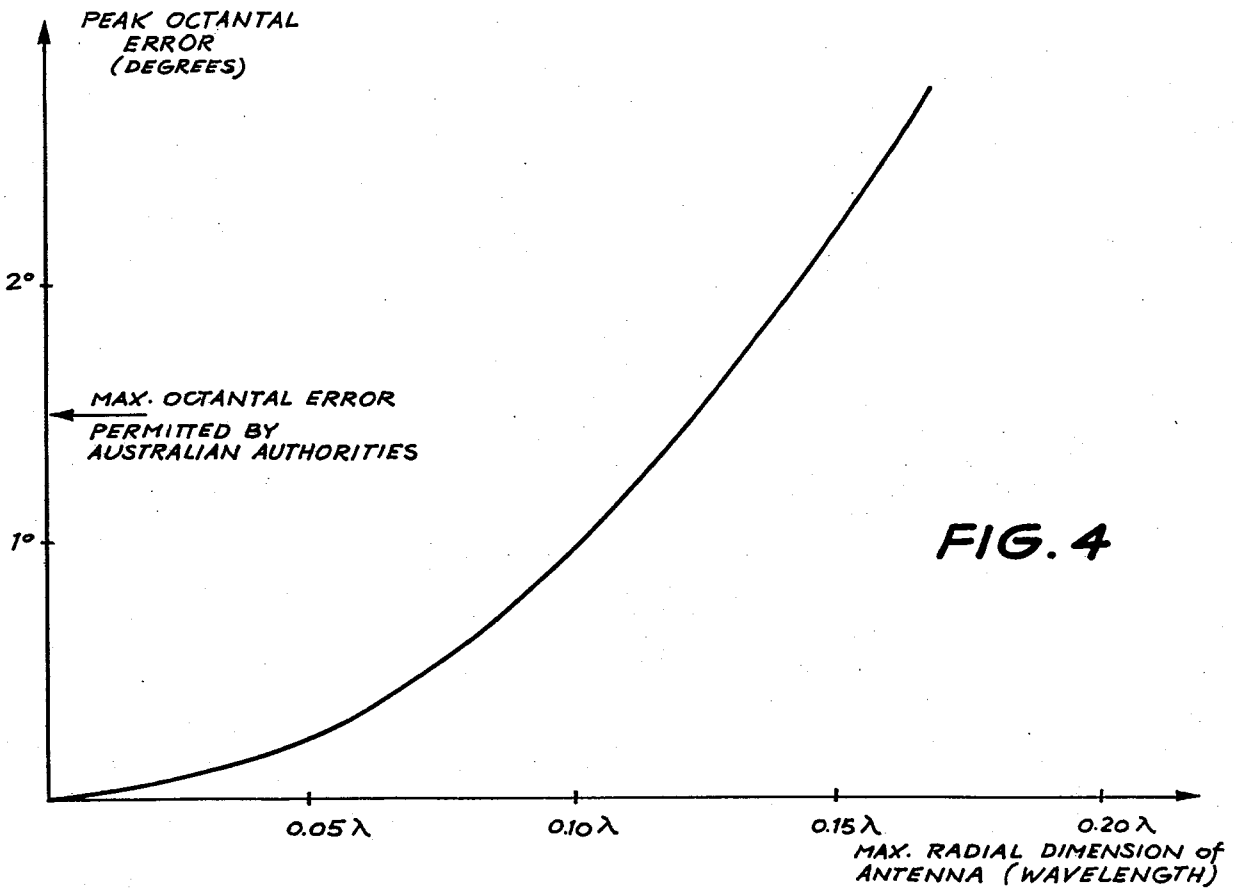
FIG. 4 shows a graph of peak octantal error plotted against radius (in wavelengths) of an antenna.

Then, the maximum diameter of the antenna is determined by constraints imposed on the maximum octantal error allowable in any given situation, this normally being specified by regulatory authorities. In this context FIG. 4 shows a plot of peak octantal error against radial dimension of an antenna and it can be seen that, in order to satisfy the Australian regulatory requirements for a peak octantal error not greater than 1.5°, the maximum radial dimension of the antenna should not exceed $0.12\lambda$. This corresponds with an antenna diameter of approximately 0.60 meters at a transmission frequency of 118 MHz.

The width w of the slot 12 is critical only to the extent that it affects the Q-factor of the antenna. It is desirable that a low Q-factor should be obtained in the interest of avoiding a too-narrow bandwidth and, therefore, the slot width should not be made too small. The slot 12 might typically have a width in the order of 5 to 15 mm.

The depth a of the cavity 13 is determined as a function of the width w and resonant length l of the slot 12, and the width b of the cavity is determined by the power transmission requirements of the antenna. In practice, the power transmission requirement of a VOR antenna is relatively low and the width b of the cavity will be determined by structural factors or manufacturing techniques rather than by electrical factors.

Figure 5:
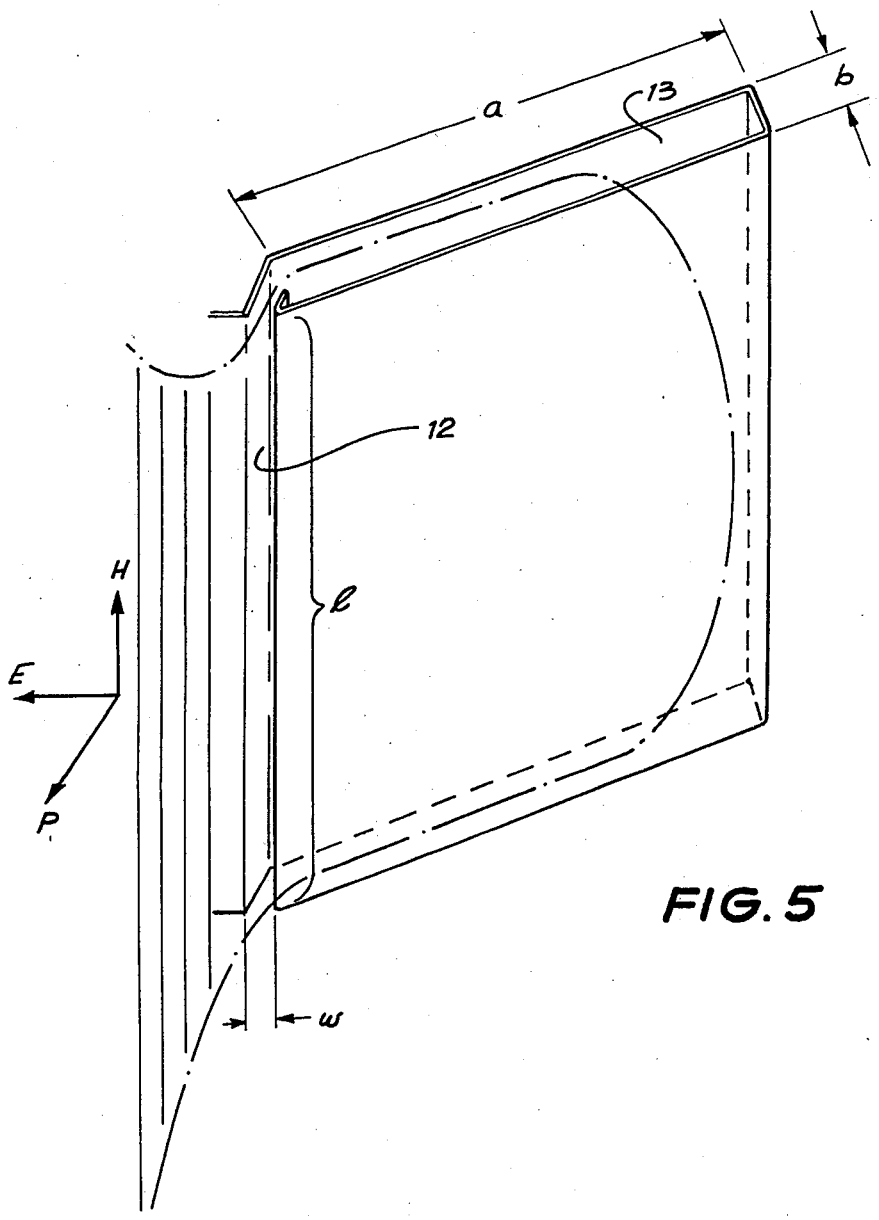
FIG. 5 illustrates, in an elementary way, a single slot and cavity of the antenna of FIG. 1.
Figure 6:
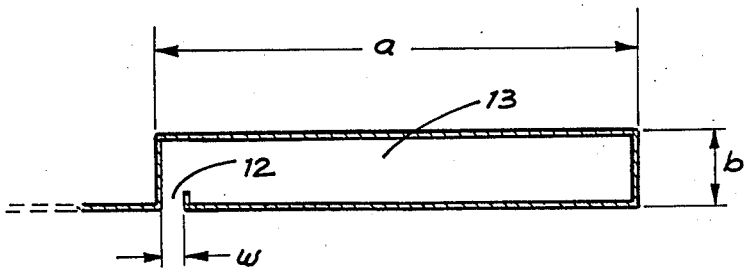
FIG. 6 shows a developed plan view of the slot and cavity arrangement which is illustrated in FIG. 5.

The cavity is illustrated in a developed (i.e., unfolded) form in FIGS. 5 and 6 of the drawings, and the rectangular box structure as illustrated may be considered as a very short waveguide cavity which operates in a kind of "dominant mode". This cavity satisfies the boundary conditions on one side of the slot which allows it to radiate totally into the opposite half plane, the radiation from the slot effectively being equivalent to that of a one-sided magnetic dipole, with the maximum H-field emanating from each end of the slot. The cavity backed slot radiates almost all of its energy into free space at the operating frequency and has a low Q-factor typically in the order of 50. The lines of H-field do not form closed loops within the "waveguide", this contrasting with the more usual form of waveguide cavity in which the H-field lines are completely contained within the cavity limits and which usually demonstrate a high Q-factor in the order of 3,000 to 10,000.

Figure 7:
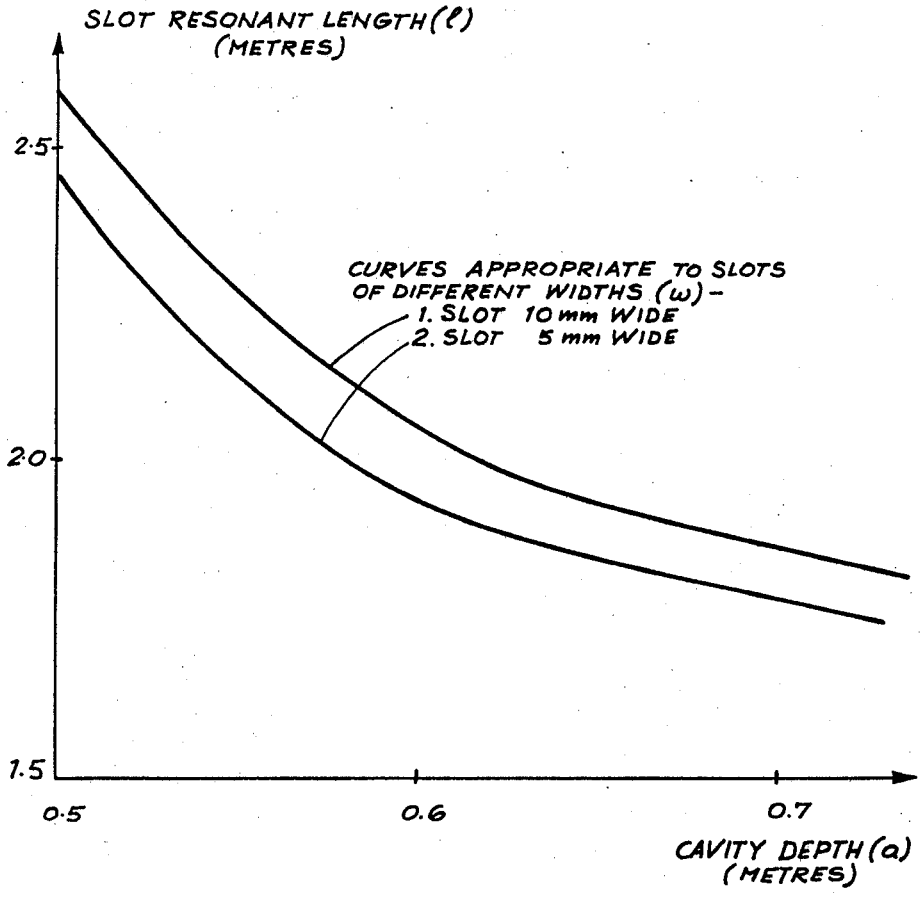
FIG. 7 is a graph which plots the relationship between dimensional characteristics of the slot and cavity arrangement which is illustrated in FIGS. 5 and 6.

As above mentioned, the depth a of the cavity 13 is determined as a function of the length l and width w of the antenna slot, and FIG. 7 illustrates the relationship of the various dimensions for a typical VOR antenna. Thus, for an antenna having a slot resonant length l of, say, 1.9 meters and a slot width w of 5 mm, the cavity should have a depth a in the order of 0.62 meters.

Each cavity backed slot unit as shown schematically in FIGS. 5 and 6 constitutes one quarter of a VOR antenna, and a complete antenna is obtained by joining four such units and compacting them in the manners shown by way of example in FIGS. 2 and 3 to reduce the octantal error to an acceptably low level.

Figure 8:
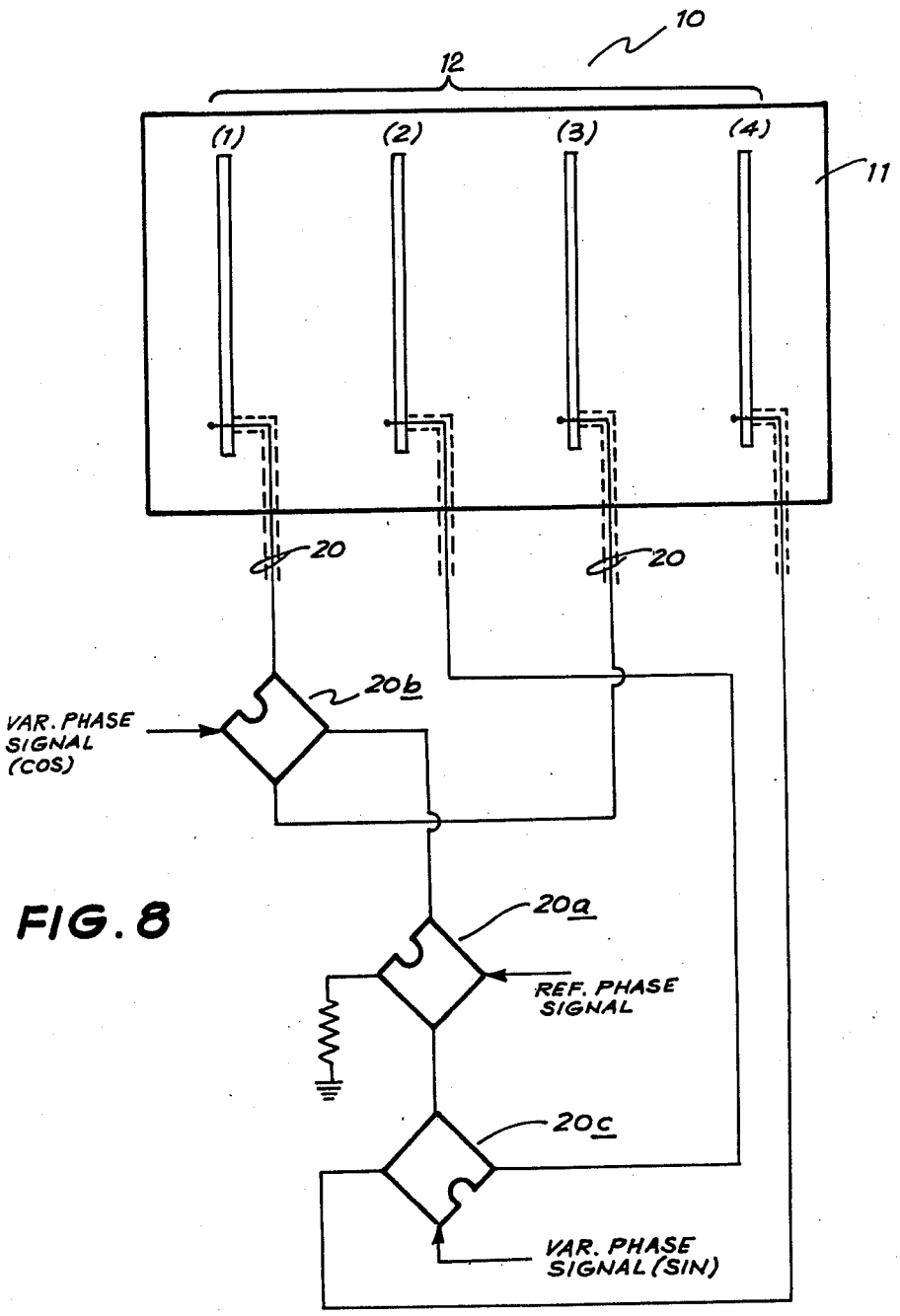
FIG. 8 illustrates the peripheral wall of the antenna of FIG. 1 when opened out into a plane and further illustrates typical electrical connections made to the slots of the antenna.

FIG. 8 shows a developed view of the internal peripheral wall 11 of the antenna 10 (with the cavities 13 being omitted) and electrical connections to the four slots 12(1) to 12(4) are shown in the figure. The electrical connections are made by coaxial conductors 20, with the inner conductor being soldered to one side of the respective slots and the outer conductor being soldered to the other side of the respective slots.

Employing the bridge arrangements 20*a*, *b* and *c* shown in FIG. 8, the reference phase signal component of the VOR signal is fed to all four slots, a cosine component of the variable phase signal is fed to the slots 12(1) and 12(3), and a sine component of the variable phase signal is fed to slots 12(2) and 12(4). Slots 12(1) and 12(3) are fed in phase opposition, as are slots 12(2) and 12(4), whereby a rotating figure-of-eight variable phase field component is radiated together with an omnidirectional reference phase field.

The bridge arrangement as shown in FIG. 8 is preferably housed within the body of the antenna structure at the lower end thereof.

Figure 9:
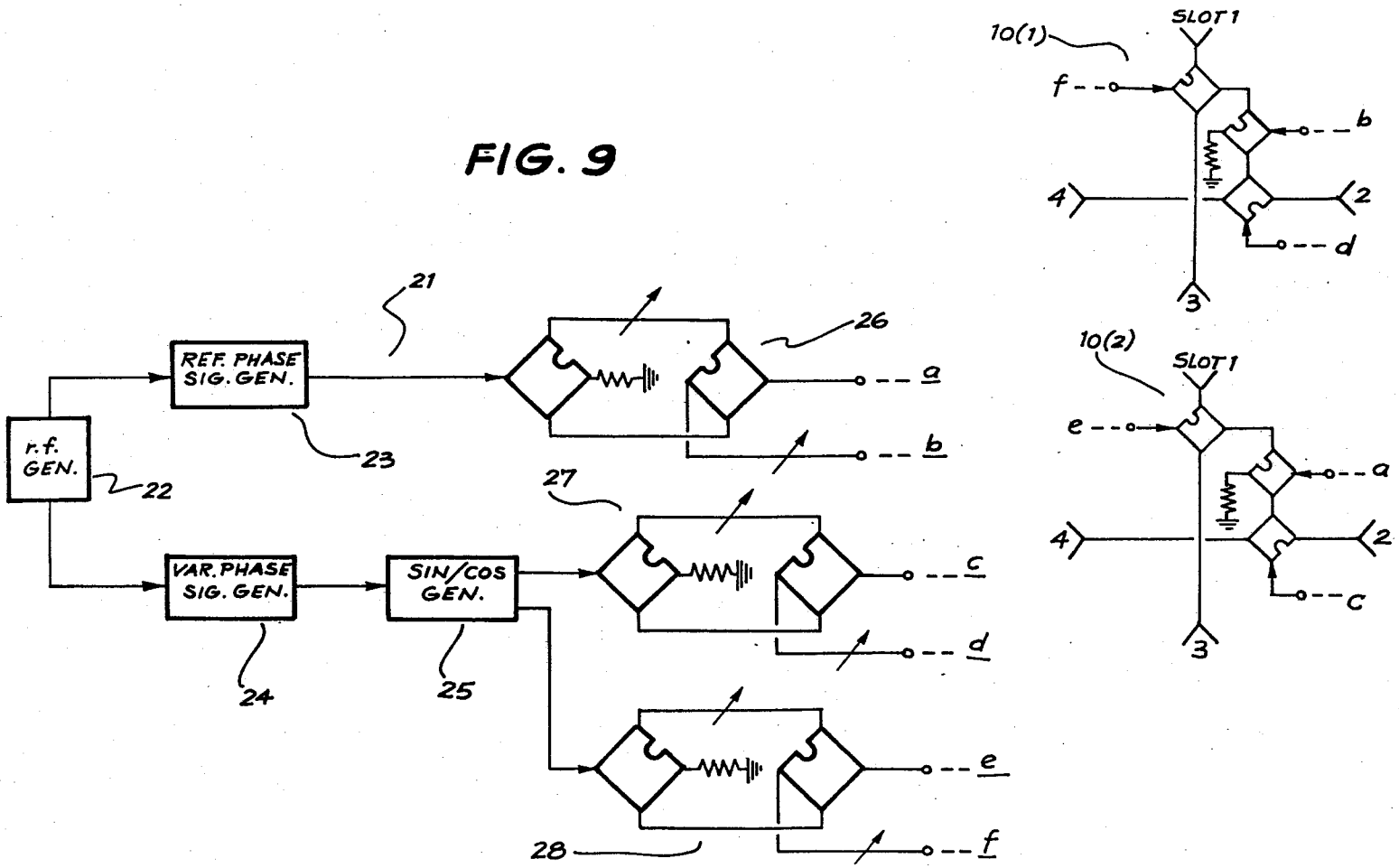
FIG. 9 shows, in schematic terms, a complete VOR system which includes a two-stack antenna array.

Reference is now made to FIG. 9 of the drawings which shows a schematic implementation of a VOR system which employs a two-stack antenna array. The two elements of the array, indicated by numerals 10(1) and 10(2), are identical and each element of the array may be constructed in the manner as hereinbefore described with reference to FIG. 1 of the drawings.

The VOR system includes a conventional VOR signal generating arrangement 21 which comprises an r.f. generator 22, a reference phase signal generator 23, a variable phase signal generator 24 and a sine/cosine function generator 25. Such arrangement in its various possible forms is well known and is not further described.

The reference and variable phase signals are fed to the lower element 10(2) of the two-stack array and, via an amplitude attenuator/phase shifter, to the upper element 10(1) of the array. The feed circuitry 26, 27 and 28 for the reference phase signal and for each of the (sine/cosine) variable phase signals each include a two-bridge arrangement, with a line stretcher being incorporated in one line between the bridges to permit amplitude adjustment of the feed signal. Also, a line stretcher is located in the output of each circuit to permit phase adjustment of the signal.

Figure 11:
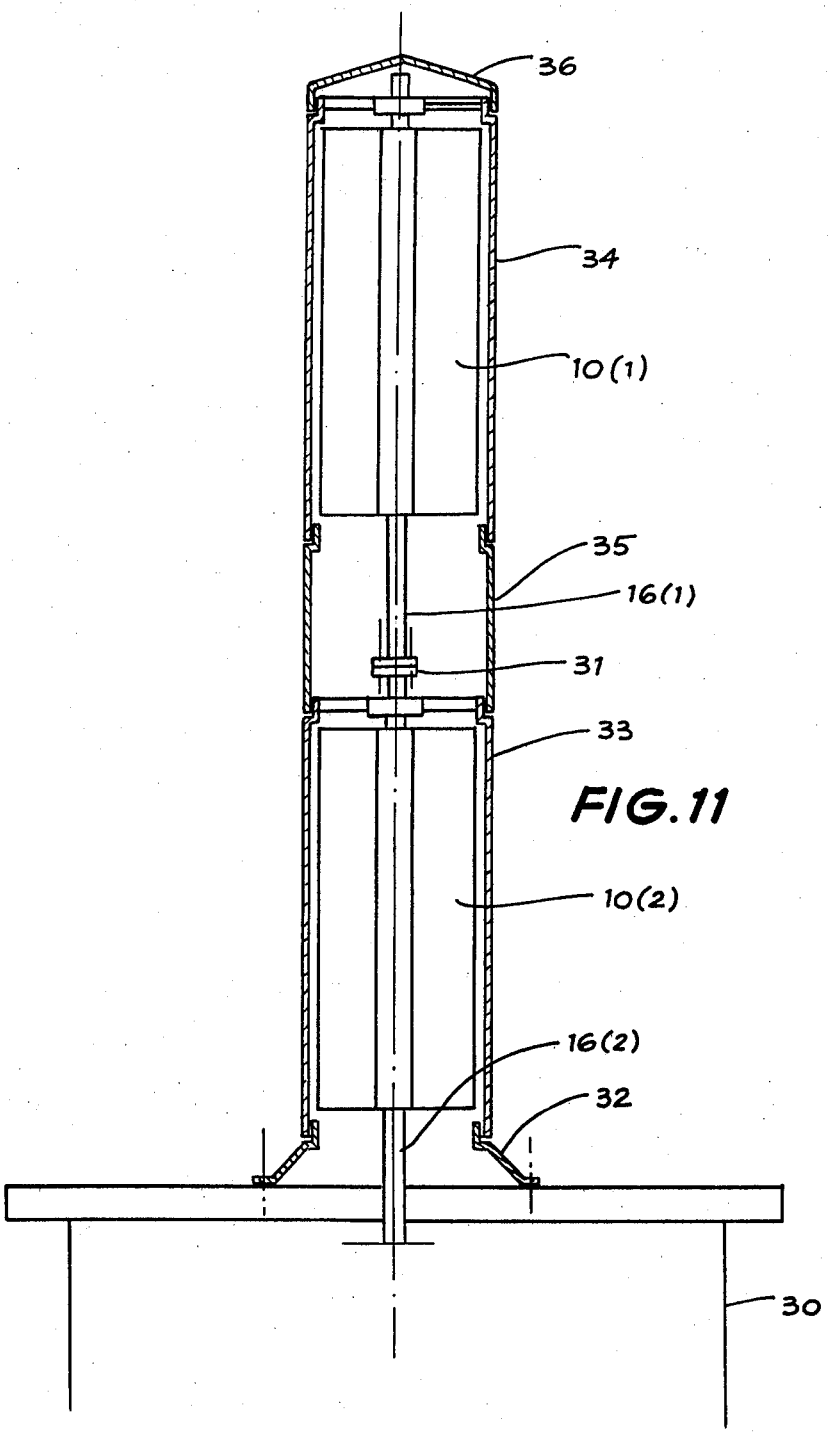
FIG. 11 shows a sectional elevation view of the upper portion of the installation which is illustrated in FIG. 10.

The two-stack antenna array as shown schematically in FIG. 9 would normally be mounted to the roof of a VOR transmission station 30 in the manner indicated in FIGS. 11 and 12. Thus, the antenna units 10(1) and 10(2) are mounted to support shafts 16(1) and 16(2) which are joined by a coupling 31, and the lower support shaft 16(2) is connected with the building structure 30. A fibreglass base module 32 provides a lower weather-shield for the structure and two fibreglass radomes 33 and 34 provide protective enclosures for the two antenna units 10(2) and 10(1) respectively. A fibreglass spacer module 35 separates the two radomes, and a weather cap 36 closes the upper radome. Access hatches 37 are located in the two radomes and in the spacer module, and the total structure is guyed by wires 38.

Figure 10:
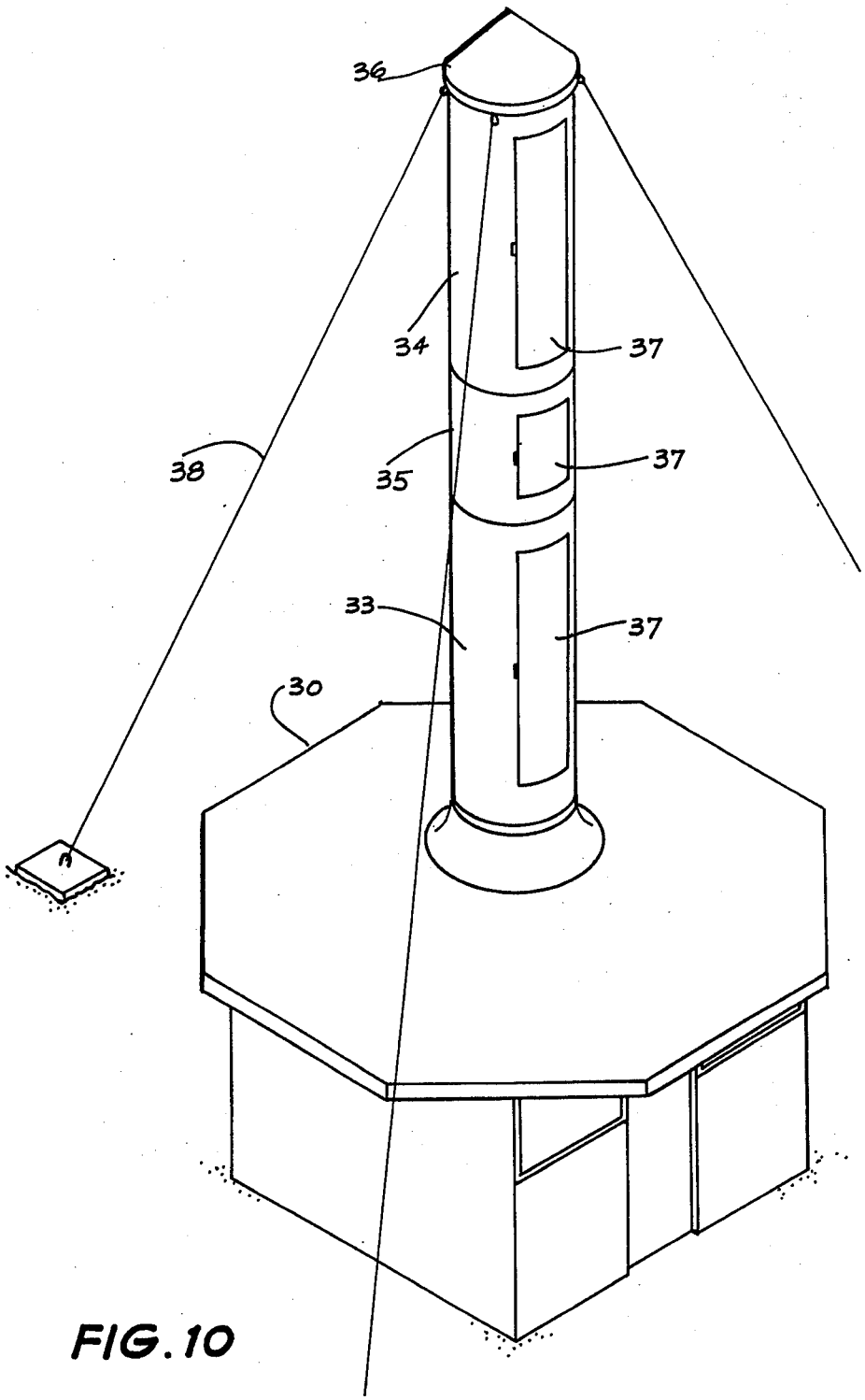
FIG. 10 shows a complete VOR installation which includes two of the antennas of FIG. 1 mounted one above the other as a two-stack antenna array.

The arrangement which is illustrated in FIGS. 10 and 11 is exemplary only of many possible arrangements.

What is claimed is:

1. A VOR antenna comprising a cylinder having four orthogonally disposed slots formed within the peripheral wall thereof, the slots extending in the direction of the longitudinal axis of the cylinder and being spaced-apart around the periphery of the cylinder, each slot being backed by a separate cavity which has a depth extending into the cylinder from the slot, the depth of each cavity being effectively greater than the radial dimension of the cylinder, and the cavities being configured to locate wholly within the cylinder.

2. An antenna as claimed in claim 1 wherein the peripheral wall of the cylinder is circular.

3. An antenna as claimed in claim 1 wherein each cavity has a depth which is effectively greater than the diametral dimension of the cylinder.

4. An antenna as claimed in claim 3 wherein the cavities each follow a spiral path in extending into the cylinder from the respective slots.

5. An antenna as claimed in claim 4 wherein adjacent cavities are separated by a common wall.

6. An antenna as claimed in claim 3 wherein each of the cavities follows a generally serpentine path in extending into the cylinder from the respective slots.

7. An antenna as claimed in claim 3 wherein each slot has a length substantially equal to the length of the cylinder and wherein each cavity has a length, in the direction of the longitudinal axis of the cylinder, which is substantially equal to the length of the associated slot.

8. An antenna as claimed in claim 3 wherein the respective cavities have an average width, in a direction transverse to the longitudinal axis of the cylinder, which is greater than the width of the associated slots.

9. An antenna as claimed in claim 3 wherein a bridging element is located adjacent at least one end of each of the slots, the bridging elements being connectable across the width of the respective slots and the position of each bridging element being selectively adjustable to change the effective length of the associated slot.

10. An antenna as claimed in claim 3 wherein at least one conductive vane element is located within each of the cavities, the vane elements extending in a longitudinal direction for a portion of the length of the associated cavities, being disposed in non-conductive relationship between the side walls of the respective cavities, and being positionable in a rotational sense to present a selectively variable area of conductive material to the passage of electromagnetic fields within the cavities.

11. An antenna as claimed in claim 3 wherein the cylinder has a diameter not greater than $0.25\lambda_c$ where $\lambda_c$ is the wavelength in the cavity of the signal to be radiated by the antenna.

12. A VOR system comprising means for generating a reference phase signal, means for generating a variable phase signal, a cylindrical antenna having four orthogonally disposed longitudinally extending slots formed within the peripheral wall thereof, means for feeding the reference phase signal to all four slots, and means for feeding sine and cosine components respectively of the variable phase signal to orthogonally disposed pairs of the slots; each slot being backed by a separate cavity which as a depth extending into the cylinder from the slot, the depth of each cavity being effectively greater than the diametral dimension of the cylinder, and the cavities being configured to locate wholly within the cylinder.

13. An antenna comprising a cylinder having four orthogonally disposed slots formed within the peripheral wall thereof, the slots extending in the direction of the longitudinal axis of the cylinder and being spaced-apart around the periphery of the cylinder, each slot being backed by a separate cavity which extends into the cylinder from the slot for a depth which is effectively greater than the diametrical dimension of the cylinder, the cavities being configured to locate wholly within the cylinder, and at least one conductive vane element being located within each of the cavities, the vane elements extending in a longitudinal direction for a portion of the length of the associated cavities, being disposed in non-conductive relationship between the side walls of the respective cavities, and being positionable in a rotational sense to present a selectively variable area of conductive material to the passage of electromagnet fields within the cavities.

* * * * *